US006119615A

United States Patent [19]

Porat

[11] Patent Number: 6,119,615

[45] Date of Patent: Sep. 19, 2000

[54] REMOVABLE LOWER DECK FOR WATERCRAFT

[76] Inventor: Joseph Safi Porat, 1327 S. Westgate Ave., #105, Los Angeles, Calif. 90025

[21] Appl. No.: 09/109,722

[22] Filed: Jul. 2, 1998

[51] Int. Cl.[7] ..... B63B 3/48

[52] U.S. Cl. ..... 114/85; 114/362; 114/364

[58] Field of Search ..... 114/343, 362, 114/364, 85; 182/55, 142, 144, 150; D12/203; 24/132 R, 134 R

[56] References Cited

U.S. PATENT DOCUMENTS

| | | | |
|---|---|---|---|
| 3,045,306 | 7/1962 | Taylor | 24/134 R |
| 3,587,123 | 6/1971 | O'Boyle | 114/362 |
| 4,007,808 | 2/1977 | Conley et al. | 182/142 |
| 4,372,243 | 2/1983 | Roope, Jr. | 114/364 |
| 4,495,883 | 1/1985 | Hoy | 114/343 |
| 4,799,447 | 1/1989 | Herbert et al. | 114/362 |
| 4,823,910 | 4/1989 | Day | 182/84 |
| 5,427,344 | 6/1995 | Beauchemin | 182/150 |

*Primary Examiner*—Sherman Basinger

[57] ABSTRACT

A removable deck for a boat is provided including a boat, a deck, and at least one rope coupled between the boat and the deck for supporting the deck in a horizontal orientation.

4 Claims, 4 Drawing Sheets

REMOVABLE LOWER DECK FOR WATERCRAFT

BACKGROUND OF THE INVENTION

1. Field of the Invention

The present invention relates to boat boarding platforms and more particularly pertains to a new removable lower deck for watercraft for providing a removable supporting surface adjacent the water next to a boat.

2. Description of the Prior Art

The use of boat boarding platforms is known in the prior art. More specifically, boat boarding platforms heretofore devised and utilized are known to consist basically of familiar, expected and obvious structural configurations, notwithstanding the myriad of designs encompassed by the crowded prior art which have been developed for the fulfillment of countless objectives and requirements.

Known prior art boat boarding platforms include U.S. Pat. No. 4,799,447; U.S. Pat. No. 5,025,747; U.S. Pat. Des. No. 324,019; U.S. Pat. No. 4,538,314; and U.S. Pat. No. 4,022,293.

In these respects, the removable lower deck for watercraft according to the present invention substantially departs from the conventional concepts and designs of the prior art, and in so doing provides an apparatus primarily developed for the purpose of providing a removable supporting surface adjacent the water next to a boat.

SUMMARY OF THE INVENTION

In view of the foregoing disadvantages inherent in the known types of boat boarding platforms now present in the prior art, the present invention provides a new removable lower deck for watercraft construction wherein the same can be utilized for providing a removable supporting surface adjacent the water next to a boat.

The general purpose of the present invention, which will be described subsequently in greater detail, is to provide a new removable lower deck for watercraft apparatus and method which has many of the advantages of the boat boarding platforms mentioned heretofore and many novel features that result in a new removable lower deck for watercraft which is not anticipated, rendered obvious, suggested, or even implied by any of the prior art boat boarding platforms, either alone or in any combination thereof.

To attain this, the present invention generally comprises a deck having a planar rectangular configuration with a top face, a bottom face, and a periphery formed therebetween. The periphery is defined by a pair of parallel long edges and a pair of parallel short edges. The deck has a matrix of square apertures formed therein between the top and bottom faces thereof. The deck further has a pair of side channels formed therein along respective short edges of the periphery. The side channel are each equipped with ends extending through the top face of the deck for allowing access to the channel. The deck also has a rear channel formed therein along a rear long edge of the periphery with ends extending through the top face of the deck. Shown in FIGS. 8 & 9 is a pair of rope mounting assemblies. Each of such assemblies include an upper portion with a pair of vertical bores formed therein. A pulley is rotatably mounted to a bottom surface of the upper portion. A protective covering is situated over the upper portion and pulley. The cover has a frusto-conical configuration with a closed top face and an open bottom face. The top face has a pair of apertures formed in alignment with the vertical bores of the upper portion. As shown in FIG. 1, a pair of first ropes are provided each having a bottom end fixedly connected within one of the bores of the corresponding rope mounting assembly. Each of the first ropes further has a top end connected to a boat. Associated therewith is a pair of second ropes each having a closed loop configuration. Each second rope is situated through the corresponding side channel of the deck and further through the pulley of the corresponding rope mounting assembly. A third rope has a pair of ends connected to the boat. The third rope is situated through one of the bores of each rope mounting assembly and further through the rear channel of the deck. FIGS. 2–4 show a locking mechanism that is situated within the deck at a midpoint of each channel. Each locking mechanism includes a vertically oriented generally circular bore formed in the deck. Such bore extends through the top face with the circular bore intersecting the channel. A plurality of teeth are formed in a portion of a periphery of the bore at a common elevation with respect to the channel. A rotating binding member is provided having a disk-shaped configuration rotatably situated within the circular bore. A knob is formed in a top face of the binding member for allowing the manual rotation thereof. The binding member further has a flat spot formed therein. During use, the binding member has a first orientation wherein the flat spot is situated adjacent the channel for allowing free passage of the associated rope therethrough. The binding member further has a second orientation wherein the binding member presses the associated rope against the teeth such that passage of the rope through the channel is precluded. At least one fender is mounted on the rear long edge of the deck for protection purpose.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new removable lower deck for watercraft apparatus and method which has many of the advantages of the boat boarding platforms mentioned heretofore and many novel features that result in a new removable lower deck for watercraft which is not anticipated, rendered obvious, suggested, or even implied by any of the prior art boat boarding platforms, either alone or in any combination thereof.

It is another object of the present invention to provide a new removable lower deck for watercraft which may be easily and efficiently manufactured and marketed.

It is a further object of the present invention to provide a new removable lower deck for watercraft which is of a durable and reliable construction.

An even further object of the present invention is to provide a new removable lower deck for watercraft which is susceptible of a low cost of manufacture with regard to both materials and labor, and which accordingly is then susceptible of low prices of sale to the consuming public, thereby making such removable lower deck for watercraft economically available to the buying public.

Still yet another object of the present invention is to provide a new removable lower deck for watercraft which provides in the apparatuses and methods of the prior art some of the advantages thereof, while simultaneously overcoming some of the disadvantages normally associated therewith.

Still another object of the present invention is to provide a new removable lower deck for watercraft for providing a removable supporting surface adjacent the water next to a boat.

Even still another object of the present invention is to provide a new removable lower deck for watercraft that includes a boat, a deck, and at least one rope coupled between the boat and the deck for supporting the deck in a horizontal orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
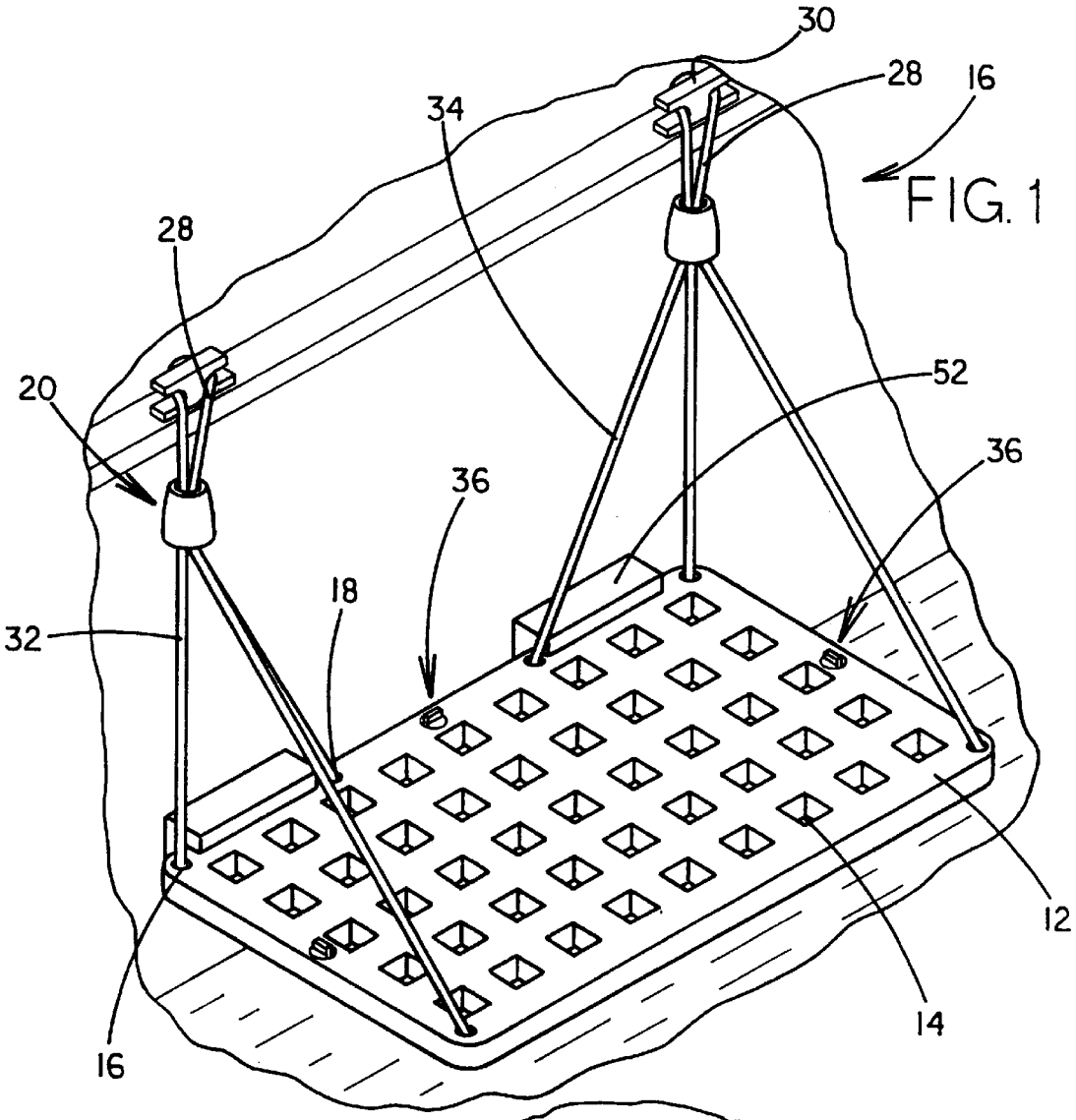
FIG. 1 is a perspective view of a new removable lower deck for watercraft according to the present invention.

With reference now to the drawings, and in particular to FIGS. 1 through 9 thereof, a new removable lower deck for watercraft embodying the principles and concepts of the present invention and generally designated by the reference numeral 10 will be described.

The present invention, as designated as numeral 10, includes a deck 12 having a planar rectangular configuration with a top face, a bottom face, and a periphery formed therebetween. The periphery is defined by a pair of parallel long edges and a pair of parallel short edges. The deck has a matrix of square apertures 14 formed therein between the top and bottom faces thereof. The deck further has a pair of side channels 16 formed therein along respective short edges of the periphery. The side channels are each equipped with ends extending through the top face of the deck for allowing access to the channel. The deck also has a rear channel 18 formed therein along a rear long edge of the periphery with ends extending through the top face of the deck.

Figure 8:
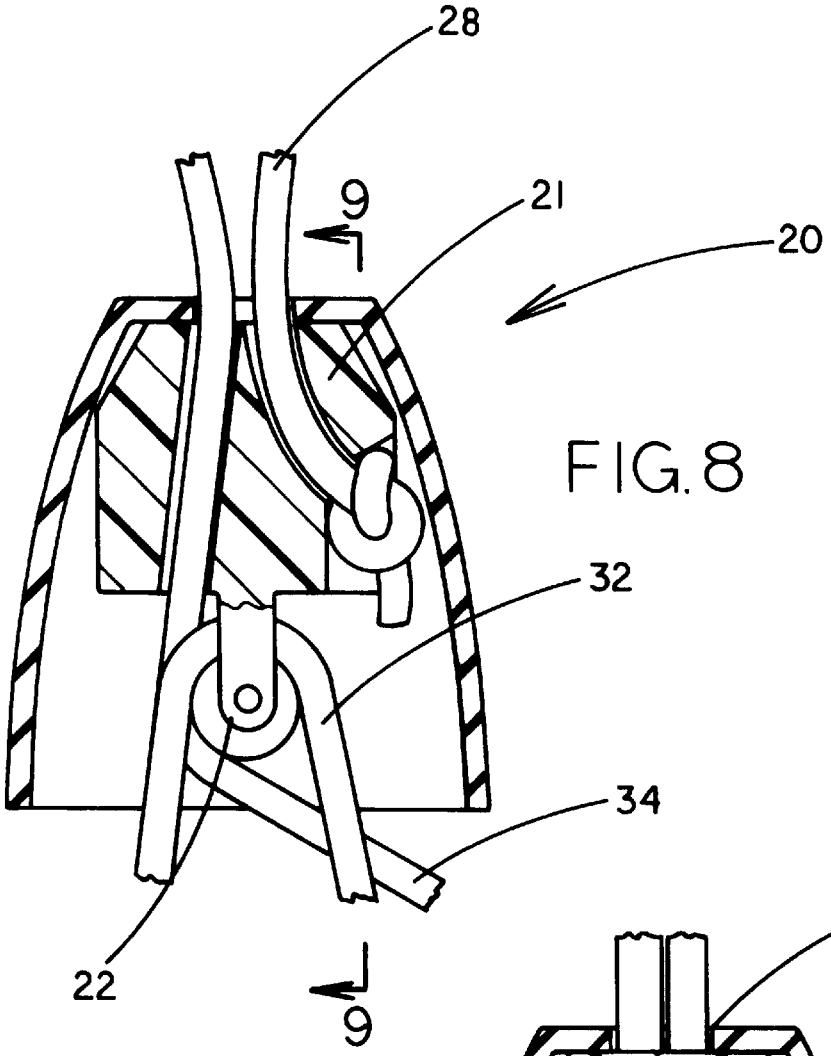
FIG. 8 is a cross-sectional view of the rope mounting assembly of the present invention.
Figure 9:
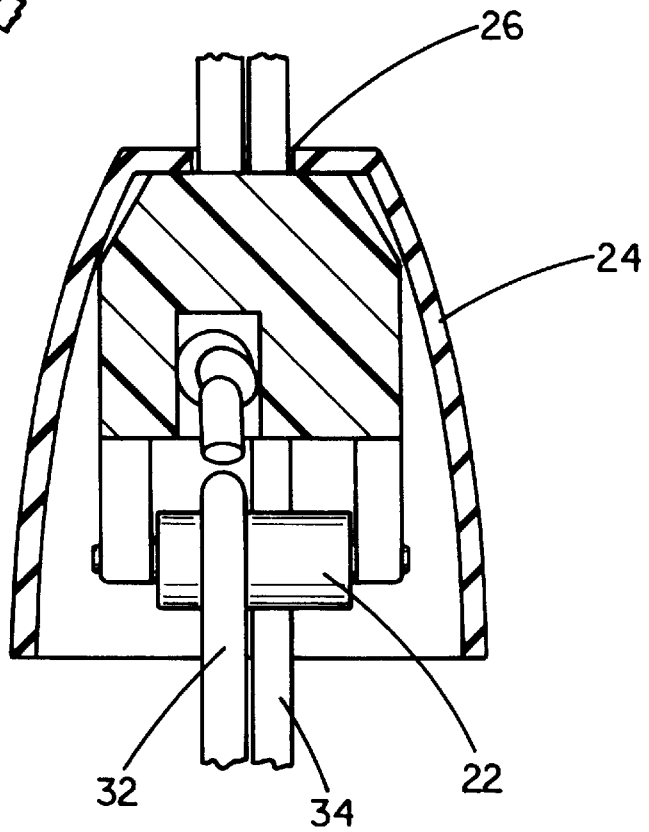
FIG. 9 is a cross-sectional view of the rope mounting assembly of the present invention taken along line 9—9 shown in FIG. 8.

Shown in FIGS. 8 & 9 is a pair of rope mounting assemblies 20. Each of such assemblies include an upper portion 21 with a pair of vertical bores formed therein. A pulley 22 is rotatably mounted to a bottom surface of the upper portion. A protective covering 24 is situated over the upper portion and pulley. The cover has a frusto-conical configuration with a closed top face and an open bottom face. The top face has a pair of apertures 26 formed in alignment with the vertical bores of the upper portion.

As shown in FIG. 1, a pair of first ropes 28 are provided each having a bottom end fixedly connected within one of the bores of the corresponding rope mounting assembly. Each of the first ropes further has a top end connected to a boat. Each coupling with the boat is ideally accomplished by way of a cleat 30.

Associated therewith is a pair of second ropes 32 each having a closed loop configuration. Each second rope is situated through the corresponding side channel of the deck and further through the pulley of the corresponding rope mounting assembly. The second ropes therefore allow pivotal adjustment of the deck about a first horizontal axis.

A third rope 34 has a pair of ends connected to the boat. The third rope is situated through one of the bores of each rope mounting assembly and further through the rear channel of the deck. The pulley is preferably of a length such that the pulley engages the third rope for guiding the same through the associated vertical bore. The third rope allows pivotal adjustment of the deck about a second horizontal axis perpendicular to the first horizontal axis.

Figure 2:
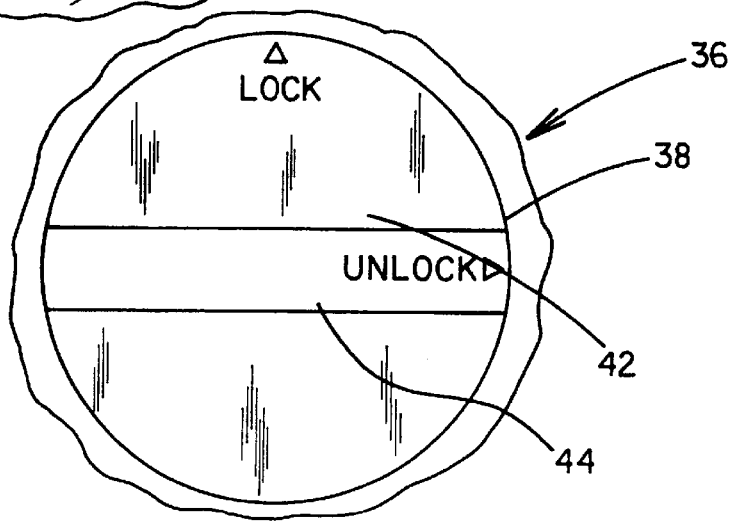
FIG. 2 is a top view of the locking mechanism of the present invention.
Figure 3:
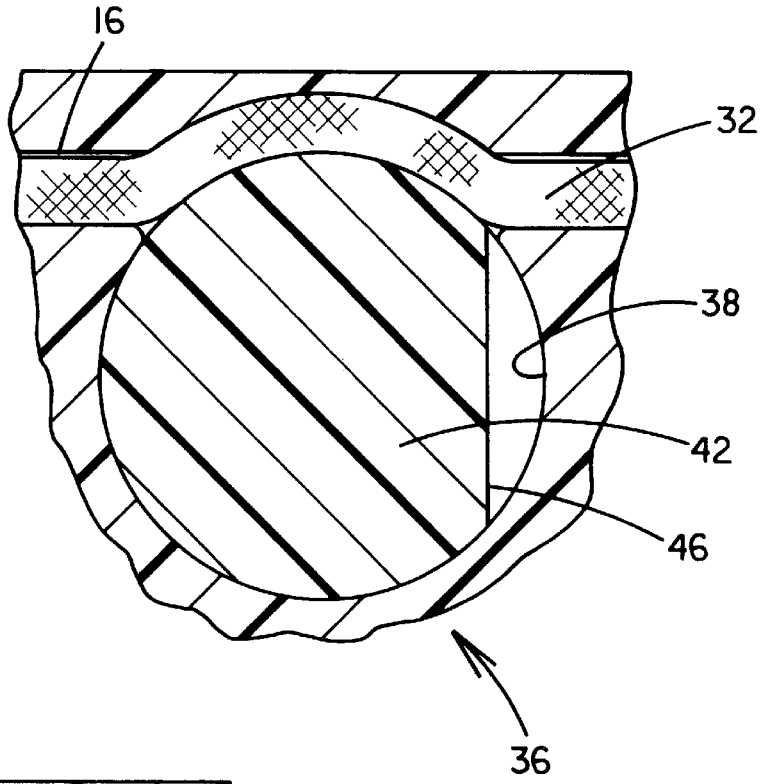
FIG. 3 is a cross-sectional view of the locking mechanism of the present invention.
Figure 4:
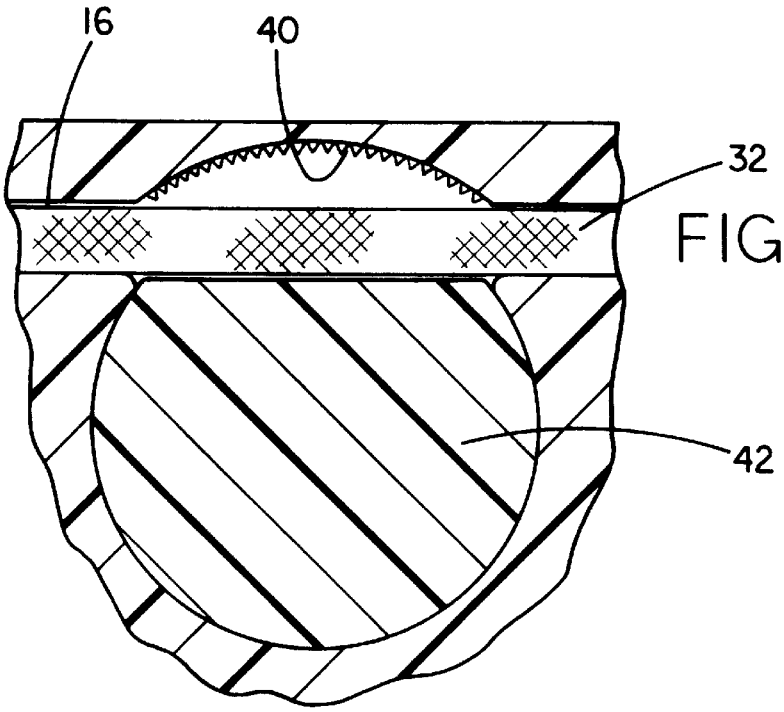
FIG. 4 is another cross-sectional view of the locking mechanism of the present invention.

FIGS. 2–4 show a locking mechanism 36 that is situated within the deck at a midpoint of each channel. Each locking mechanism includes a vertically oriented generally circular bore 38 formed in the deck. Such bore extends through the top face and intersects the associated channel. A plurality of teeth 40 are formed in a portion of a periphery of the bore at a common elevation with respect to the channel. A rotating binding member 42 is provided having a disk-shaped configuration rotatably situated within the circular bore. A knob 44 is formed in a top face of the binding member for allowing the manual rotation thereof. The binding member further has a flat spot 46 formed therein.

During use, the binding member has a first orientation wherein the flat spot is situated adjacent the channel for allowing free passage of the associated rope therethrough. The binding member further has a second orientation wherein the binding member presses the associated rope against the teeth such that passage of the rope through the channel is precluded.

Figure 5:
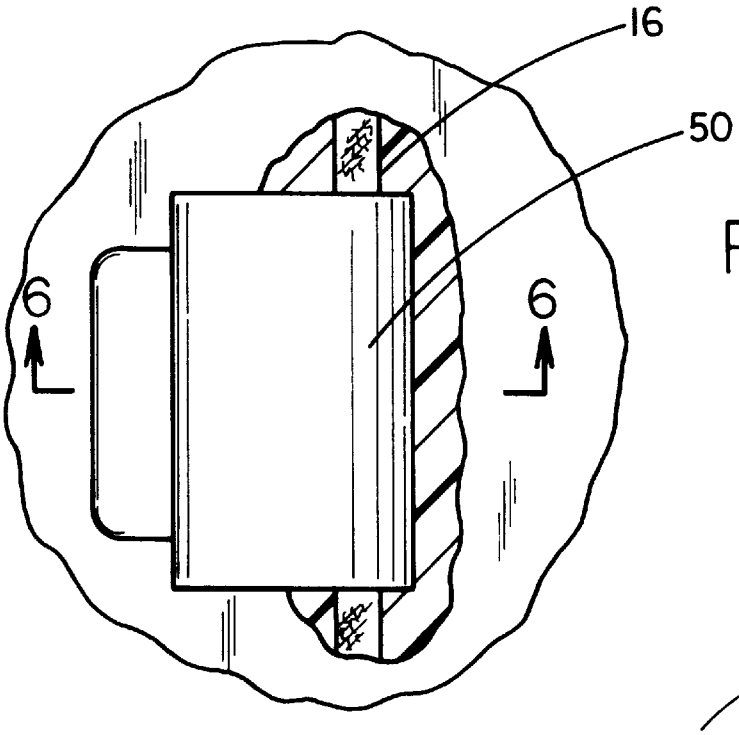
FIG. 5 is a top view of an alternate design of the locking mechanism.
Figure 6:
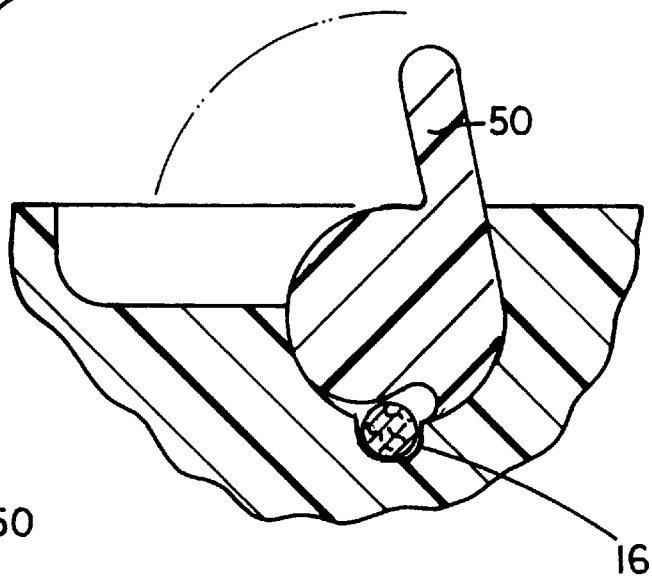
FIG. 6 is a cross-sectional view of the alternate embodiment of the FIG. 5.
Figure 7:
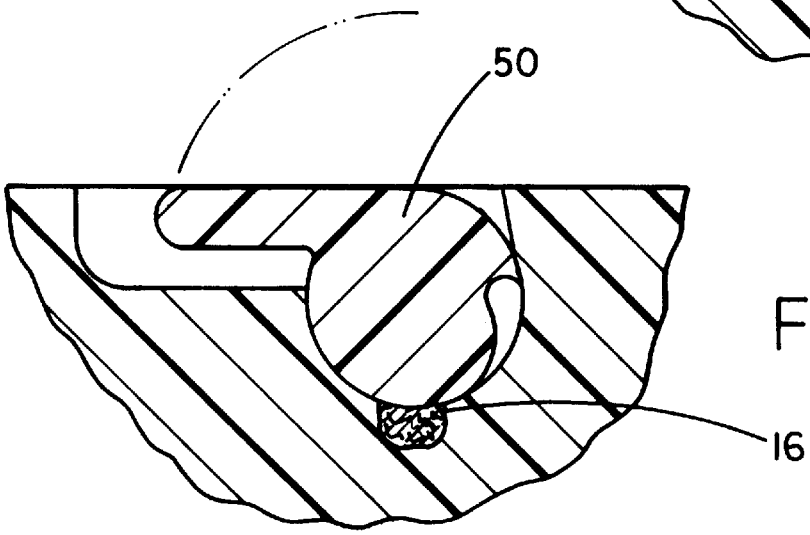
FIG. 7 is a cross-sectional view of an alternate design associated with FIG. 5.

In alternate embodiments, locking mechanisms shown in FIGS. 5–7 may be employed in lieu of the locking mechanism described hereinabove. Such alternate designs each include a rotating disk 50 which is adapted to rotate about an axis position in parallel with the corresponding channel.

At least one fender 52 is mounted on the rear long edge of the deck for protection purpose. As shown in FIG. 1, when the deck is in its operative orientation, the rear long edge abuts a side of the boat and the deck resides in a horizontal orientation. Further, the rope mounting assemblies rest against the boat above opposite rear corners of the deck. For precluding movement of the deck with respect to the boat, the binding members are put in the second orientation thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A removable deck for a boat comprising, in combination:

a deck having a planar rectangular configuration with a top face, a bottom face, and a periphery formed therebetween defined by a pair of parallel long edges and a pair of parallel short edges, the deck having a matrix of square apertures formed therein between the top and bottom faces thereof, a pair of side channels formed therein along respective short edges of the periphery with each having ends extending through the top face of the deck, and a rear channel formed therein along a rear long edge of the periphery with ends extending through the top face of the deck;

a pair of rope mounting assemblies each including an upper portion with a pair of vertical bores formed therein, a pulley rotatably mounted to a bottom surface of the upper portion, a protective covering situated over the upper portion and pulley and further having a frusto-conical configuration with a closed top face and an open bottom face, the top face having a pair of apertures formed in alignment with the vertical bores of the upper portion;

a pair of first ropes each having a bottom end fixedly connected within one of the bores of the corresponding rope mounting assembly and a top end connected to a boat;

a pair of second ropes each having a closed loop configuration situated through the corresponding side channel of the deck and through the pulley of the corresponding rope mounting assembly;

a third rope having a pair of ends connected to the boat with the third rope situated through one of the bores of each rope mounting assembly and further through the rear channel of the deck;

a locking mechanism situated within the deck at a midpoint of each channel, each locking mechanism including a vertically oriented generally circular bore formed in the deck and extending through the top face with the circular bore intersecting the channel, a plurality of teeth formed in a portion of a periphery of the bore at a common elevation with respect to the channel, and a rotating binding member having a disk-shaped configuration rotatably situated within the circular bore with a knob formed in a top face thereof for allowing the manual rotation of the binding member, the binding member having a flat spot formed therein, whereby the binding member has a first orientation wherein the flat spot is situated adjacent the channel for allowing free passage of the associated rope therethrough and a second orientation wherein the binding member presses the associated rope against the teeth such that passage of the rope through the channel is precluded; and at least one fender mounted on the rear long edge of the deck for protection purposes;

whereby the rear long edge of the deck abuts a side of the boat in a horizontal orientation, the rope mounting assemblies rest against the boat above opposite rear corners of the deck and the binding members are in the second orientation thereof for precluding movement of the deck with respect to the boat.

2. A removable deck for a boat comprising:

a deck having a top face, a bottom face, and a periphery formed therebetween defined by a pair of parallel long edges and a pair of parallel short edges, the deck having a matrix of apertures formed therein between the top and bottom faces thereof, a pair of side channels formed therein along respective short edges of the periphery with each having ends extending through the top face of the deck, and a rear channel formed therein along a rear long edge of the periphery with ends extending through the top face of the deck;

a pair of mounting assemblies each including an upper portion with a pair of vertical bores formed the rein, a pulley rotatably mounted to a bottom surface of the upper portion;

a pair of elongate first flexible members each having a bottom end fixedly connected in one of the bores of the corresponding mounting assembly and a top end connected to a boat;

a pair of elongate second flexible members each having a closed loop configuration situated through the corresponding side channel of the deck and through the pulley of the corresponding rope mounting assembly;

an elongate third flexible member having a pair of ends, the third flexible member being situated through one of the bores of each mounting assembly and further through the rear channel of the deck; and a locking mechanism mounted on the deck in each channel, each locking mechanism including a vertically oriented bore formed in the deck and extending through the top face with the bore intersecting the channel, a plurality of teeth formed in a portion of a periphery of the bore, and a rotating binding member having a disk-shaped configuration rotatably situated in the bore with a knob formed in a top face thereof for allowing the manual rotation of the binding member, the binding member having a substantially flat spot formed therein, whereby the binding member has a first orientation wherein the substantially flat spot is situated adjacent the channel for allowing free passage of the associated rope therethrough and a second orientation wherein the binding member presses the associated rope against the teeth such that passage of the rope through the channel is precluded.

3. A removable deck for a boat as set forth in claim 2 wherein the each of the mounting assemblies has a protective covering situated over the upper portion and pulley and further having a frusto-conical configuration with a closed top face and an open bottom face, the top face having a pair of apertures formed in alignment with the vertical bores of the upper portion.

4. A removable deck for a boat as set forth in claim 2 further comprises at least one fender being mounted on the rear long edge of the deck for protection purposes.

* * * * *